United States Patent [19]

Wiklund et al.

[11] 4,050,366

[45] Sept. 27, 1977

[54] GRATING

[76] Inventors: Curt Helmer Wiklund; Gunnar Sten Frödin, both of Vattugatan 14A, Sundbyberg, Sweden

[21] Appl. No.: 635,353

[22] Filed: Nov. 26, 1975

[30] Foreign Application Priority Data

Nov. 27, 1974 Sweden ..... 7414864

[51] Int. Cl.[2] ..... F24F 13/00

[52] U.S. Cl. ..... 98/110; 15/238; 52/473; 98/114; 98/121 R

[58] Field of Search ..... 98/103, 108, 110, 114, 98/121 R; 15/237, 238; 52/180, 473, 664, 668, 669, 753 D

[56] References Cited

U.S. PATENT DOCUMENTS

| | | | |
|---|---|---|---|
| 2,845,150 | 7/1958 | McBerty | 52/753 D |
| 3,060,834 | 10/1962 | Cira | 98/121 R |
| 3,333,525 | 8/1967 | Tischuk | 98/121 R |
| 3,730,074 | 5/1973 | Helwig | 98/121 R |

*Primary Examiner*—Ronald C. Capossela

*Attorney, Agent, or Firm*—Birch, Stewart, Kolasch and Birch

[57] ABSTRACT

The present invention relates to an improved grating structure comprising carrying bars, and a plurality of ribs interlocked in said bars. Each of said ribs has holes strategically placed on their extremities such that a locking rod may be inserted through said holes so as to tie the ribs to the carrying bars. The grating structure may be further stabilized by the utilization of locking plates on the ends of the carrying bars.

9 Claims, 10 Drawing Figures

GRATING

The present invention relates to a grating, for example for use in ventilation openings in house walls or as a foot scraper outside of doors. Gratings for these and similar objects generally are assembled of several ribs and at least two carrying bars provided with grooves for supporting the ribs. The ribs may be in parallel with each other and arranged like a louvre and close to their ends be secured in the grooves in the carrying bars, which latter are substantially perpendicular to the longitudinal direction of the ribs.

Gratings of this kind have heretofore been manufactured in such a manner, that the ribs were inserted into the grooves in the carrying bars and welded thereon. The welding, however, was troublesome and took some time. The gratings, therefore, tended to become expensive. The material choice for the grating, besides, is limited substantially to weldable materials. When, moreover, a rib becomes curved or crooked, its exchange is tedious and difficult.

It is, therefore, one object of the present invention to construct a grating of ribs and carrying bars which is simple and cheap to manufacture and repair. A further object of the present invention is to construct a grating of ribs and carrying bars, at which separately manufactured ribs and carrying bars simply and cheaply can be assembled without welding to a stable coherent grating.

In order to achieve these objects and to eliminate the disadvantages of conventional gratings, according to the present invention the carrying bars are tubular and the ribs provided with holes in those parts which are intended to be inserted into the grooves of the carrying bars. The grating is held together by means of locking rods passing through the holes of the ribs within the carrying bars. The locking rods are locked by being turned in said holes.

By securing the ribs on the carrying bars the mounting of the grating is hereby facilitated to a substantial degree. No welding must be carried out. The ribs are only pushed into the grooves in the carrying bars, whereafter the locking rods are pushed in from one end of the respective carrying bar through the holes in the ribs. The square rods are thereafter turned through a part of a revolution. The locking rods thereby lock the ribs very efficiently relative to the carrying bars. The time saving by this assembly compared with welding is very substantial. Even when the grating is one meter high, and the ribs are arranged in a tight relationship, according to the present invention the ribs can be locked to the carrying bars in a very short period of time, generally in less than one minute.

The stability of gratings according to the present invention, is substantially improved over that of conventional gratings. The tubular carrying bars being rigid per se become still more rigid when the ribs are secured with the locking rods. When the holes in the ribs are positioned so that they only partially are located inside of the tube walls of the carrying bars, or so that they are located tightly adjacent the inside of the tubular carrying bars when the ribs are inserted into the grooves in the carrying bars, after turning the locking rods they also become pressed against the inside of the respective carrying bar thus further securing the assembly. The rigidness of the grating is hereby still further improved.

A damaged rib can be exchanged very easily and in a very short time. The locking rods are only to be loosened and pulled out some distance.

Further characterizing features and advantages of gratings according to the invention should become apparent from the following description of preferred embodiments. It should be understood, however, that the detailed description, while indicating preferred embodiments of the invention, are given by way of illustration only, since various changes and modifications within the spirit and scope of the present invention will become apparent to those skilled in the art from this detailed description. Referring now to the figures there is seen:

Figure 2:
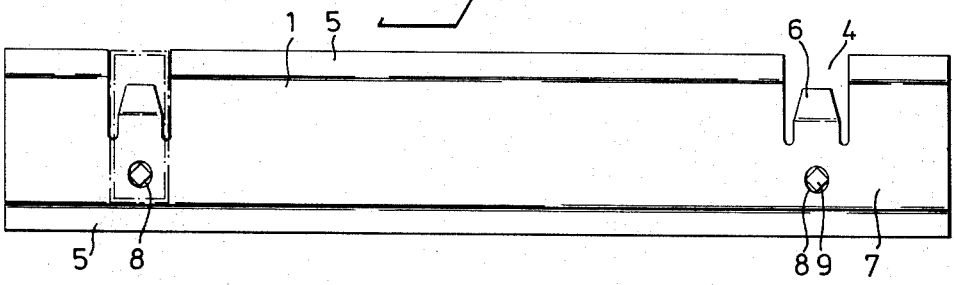
FIG. 2 shows a first embodiment of a rib seen in the longitudinal direction of the carrying bars as the rib is positioned in the grating.
Figure 3:
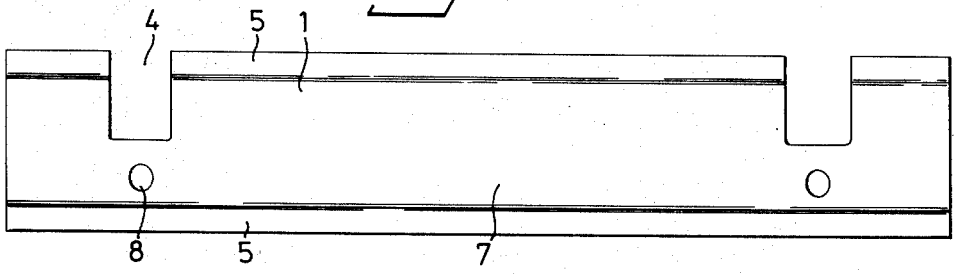
Figure 4:
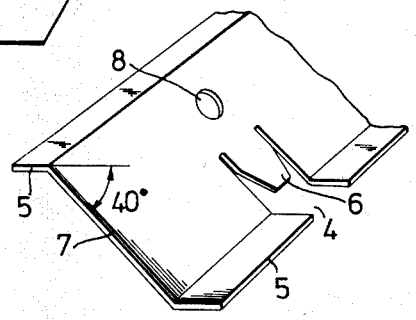
Figure 5:
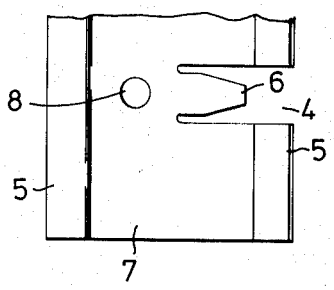
Figure 6:
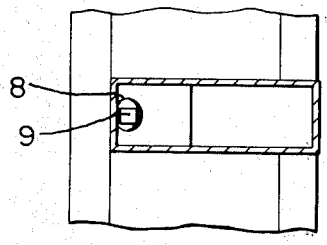
Figure 7:
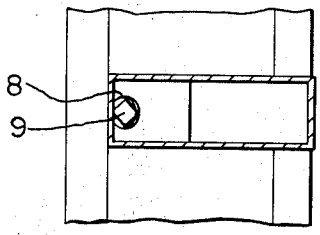
Figure 8:
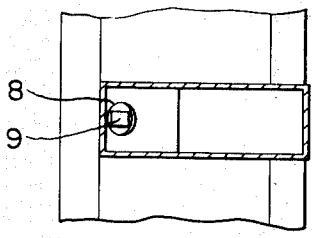
Figure 10:
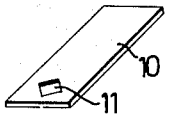
Figure 9:
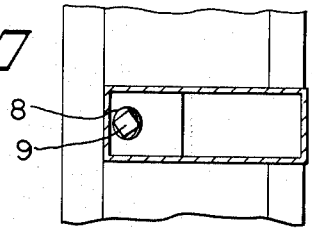

FIG. 3 shows a second embodiment of a rib seen from the same direction as the rib in FIG. 2, FIG. 4 shows the section of a rib seen obliquely from above, i.e. in the longitudinal direction of the carrying frame, as the rib is positioned in the grating, FIG. 5 shows a rib seen at a right angle to its central portion, FIG. 6 is a section through a carrying bar immediately above a rib, and through a portion of said rib, FIG. 7 is a section through a carrying bar etc. according to FIG. 6, but after the square rod has been turned to locking position in the holes of the ribs, FIG. 8 is a section through a carrying bar etc. according to FIG. 6, but with a somewhat different position of the hole on the rib, FIG. 9 is a section through a carrying bar etc. according to FIG. 7, but with a somewhat different position of the hole on the rib, FIG. 10 shows locking means for fixing a square rod in locked position.

Figure 1:
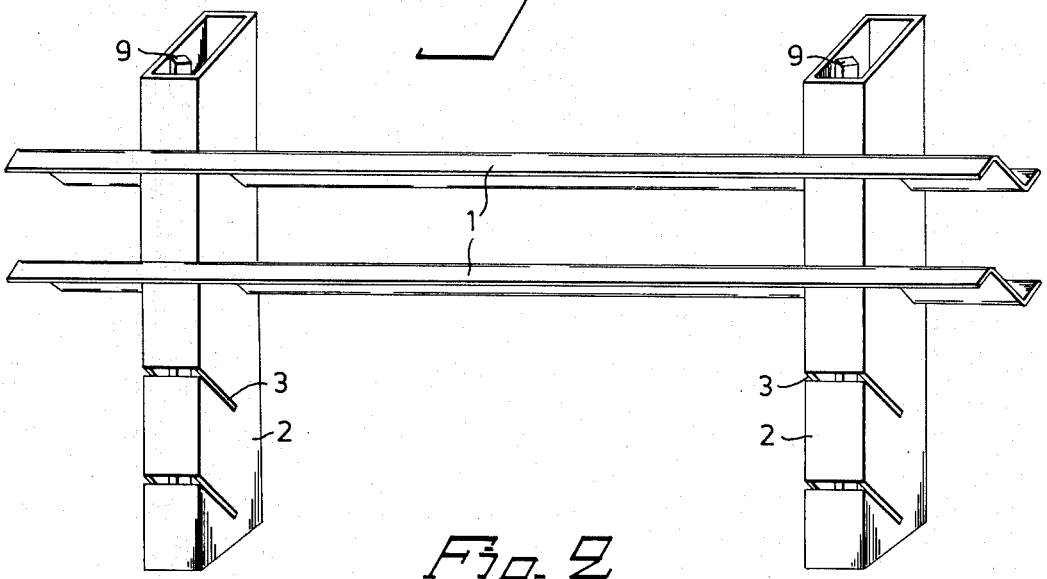
FIG. 1 shows a grating obliquely from the side.

The grating shown in FIG. 1 is intended to be inserted into a ventilation opening in a house wall. It can be inserted into the opening with or without a walling-in frame. The grating is assembled of several equal ribs 1 arranged in parallel like a louvre. The ribs are secured, close to their ends in two tubular carrying bars 2, which are substantially perpendicular to the longitudinal direction of the ribs and have a rectangular section. The carrying bars are provided with grooves 3 in a spaced relationship of 30 mm for supporting the ribs 1. Said grooves may be saved or otherwise cut out and extend from one narrow side of the carrying bars inward to the centre of the broad sides of the carrying bars. The grooves lie in planes forming an angle of about 40° with the longitudinal direction of the carrying bars.

FIG. 2 shows a first embodiment of a rib seen in the longitudinal direction of the carrying frames as the rib is oriented in the grating, while FIGS. 4 and 5 show a portion of the same rib seen from somewhat different directions. The rib has a plane central portion 7 and two mutually parallel plane long sides 5 bent to an angle of 40° to the central portion. The rib is provided close to its ends with recesses 4. The portions of the carrying bars which are located directly in front of the grooves 3 fit into the recesses 4. In the bottom of said recesses a tip 6 may be formed which projects into the recess and is enclosed by the carrying bar when the rib is pushed into a groove in the carrying bar. The rib, further, has a circular hole 8 close to each recess.

FIG. 3 shows a second preferred embodiment of a rib in a grating according to FIG. 1. It differs from the first embodiment only in that it has no tips projecting from the bottom of the recesses.

The ribs and carring bars in the grating according to FIG. 1 are held together, not only by the grooves, recesses and possible tips, but also by the square rods 9 passing through the holes 8 inside of the tube walls of the respective carrying bar. Said square rods can in a certain position easily be inserted into the holes from one end of the respective carrying bar and be locked in the holes by turning the rods in relation to said firstmentioned position.

FIGS. 6–9 show sections through a carrying bar perpendicular to its longitudinal direction and parts of a rib inserted into a groove in the carrying bar. FIGS. 6–7 refer to a rib with such a location of the hole 8 that the hole is only partially located inside of the tube wall of the carrying bar. FIGS. 8–9, however, refer to a rib where the hole 8 is so positioned that the entire hole is located on the inside. Both said locations of the holes in relation to the recesses in the ribs and the dimensions of the carrying bars are in principle possible at a grating according to FIG. 1, but the locations according to FIGS. 6 and 7 are to be preferred from a stability point of view.

As appears from FIGS. 6–9, the form and the location of the recesses, tips and holes of the ribs are so adjusted to the form of the carrying bars and their grooves that, when the rib is inserted into a groove, the recess can be caused to at least partially enclose that portion of the tube wall of the carrying bar which is located directly in front of the groove, at the same time as the tip is enclosed by said tube wall and the hole at least partially is located inside of the tube wall of the carrying bar. The projection of the holes of the rib in a plane perpendicular to the longitudinal direction of the carrying bar is of elliptic shape, as shown in FIGS. 6–9. This is due to the fact that the central portion of the rib, in which portion the circular holes are made, forms an angle of about 40° with the longitudinal direction of the carrying bar when the rib is being pushed into a groove.

FIGS. 7 and 9 differ from FIGS. 6 and 8 in that the square rod 9 is turned through about 45° about its longitudinal axis. The square rod has a square section with a diagonal, which is so much smaller than the diameter of the holes that in the position of turning shown in FIGS. 6 and 8 it can easily be inserted into the holes or those portions of the holes which are located inside of the tube wall of the carrying bar. The diagonal, further, is sufficiently great in relation to the small axis of the elliptic-shaped projection of the holes, that the square rod upon its turning to the position shown in FIG. 8 abuts the edges of the hole, and to the position shown in FIG. 7 also abuts the tube wall of the carrying bar. By deformation of the hole walls and possibly also of the square rod in the position shown in FIGS. 7 and 9, the square rod is locked against the ribs. The square rods, carrying bars and ribs hereby form a very stable interconnected grating, particularly when the holes of the ribs are located as shown in FIGS. 6 and 7.

For securing the assembled grating, locking members can be used which lock the square rods against turning about their longitudinal axis from the position shown in FIGS. 1, 7 and 9. FIG. 10 shows a locking member formed as a locking plate 10. It has the same shape as the section of the carrying bars and fits into their ends. It also has a recess 11 adjusted to the section and turning position of the square rod. After the assembly of the grating, the locking plates are positioned as plugs into the ends of the carrying bars where they prevent undesired turning of the square rods passing through the recesses 11.

The invention, of course, is not restricted to the variants of the embodiments described. The ribs, of course, need not be equal and in parallel, and the carrying bars need not be perpendicular to the ribs. The section of the carrying bars need not be rectangular, either, and the grooves need not be equal nor in parallel. The main feature is that the ribs can be inserted into the grooves in the carrying bars so that the holes at least partially are located inside of the tube wall of the carrying bars, and that the locking bars can be inserted into the holes and locked therein by turning.

It is in principle possible, instead of circular holes in the ribs and grooves forming angles with planes perpendicular to the longitudinal direction of the carrying bars, to provide the ribs with holes of elliptic or irregular shape and at the same time so to form the grooves that the central portions of the ribs are perpendicular to the longitudinal direction of the carrying bars.

Square rods in this connection are to be understood as rods having a substantially equiform section, which is defined by four straight or almost straight sides and comprises a diagonal exceeding in length the longest side. A square rod, thus, instead of the square section shown in FIGS. 6–9 may have a substantially rectangular or rhombic section. The essential feature is that the square rod can be locked in the holes by being turned about its longitudinal axis. The sides of the square rod, therefore, must not be parallel in pairs, either, provided that the diagonal enclosed is substantially longer than the longest side.

Instead of the locking plate shown in FIG. 10, of course, a somewhat different locking member can be used. The main feature is that the locking member has a recess adjusted to the section and turning of the respective square rod so that the locking member at least partially can be inserted from the end into a carrying bar so that the square rod passes through the recess only when the square rod has a certain orientation relative to the surrounding carrying bar.

Also other modifications of the grating shown in FIGS. 1–10, can be imagined within the scope of the claims. These modifications are intended to be encompassed within the scope of the present invention.

We claim:

1. A grating structure comprising two tubular carrying bars each provided with a plurality of parallel grooves, a plurality of ribs each inserted into said grooves in such a manner so as to support said bars in a substantially parallel position one to the other near the ends of said ribs and being substantially perpendicular to said ribs, each of said ribs having a hole on each end which, upon the insertion of said ribs into said grooves, is at least partially located inside the walls of each carrying bar, square rods inserted into each carrying bar through the holes in said ribs, turned about their longitudinal axis so as to abut those parts of the grating which define the portions of the holes which are located inside the walls of the carrying bars.

2. A grating according to claim 1, wherein each rib near said hole is provided with a recess defining a tip of the rib, which tip and recess have a form and location adjusted to the respective carrying bar and grooves, so that the recess near the hole partially encloses the tubular wall of the carrying bar, and the tip partially is enclosed by the tube wall of the carrying bar.

3. A grating according to claim 1, comprising two locking plates for locking the turning of the square rods about their longitudinal axis in relation to said respective carrying bar, which locking plates at least partially are inserted into said respective carrying bar and have a recess adjusted to the section and the turning angle of the respective square rod, through which recess said respective square rod passes.

4. The grating as defined in claim 1, wherein said holes are substantially circular, and said grooves lie in planes forming an acute angle with the longitudinal direction of the carrying bars, the projection of the holes in the ribs in a plane perpendicular to the longitudinal direction of the respective carrying bar being elliptical in shape, the cross section of each square rod having a diagonal greater than the small axis of said ellipse and smaller than the big axis of said ellipse.

5. The grating as defined in claim 4, wherein said grooves lie in planes forming an acute angle of about 40° with the longitudinal direction of the carrying bars.

6. A grating according to claim 1, further including locking plates for locking the turned square rods about their longitudinal axis in relation to said respective carrying bar, said locking plates being at least partially inserted into the ends of said respective carrying bars and having a recess through which said respective square rods pass.

7. An improved grating structure comprising two tubular carrying bars each provided with a plurality of parallel grooves lying in planes forming an acute angle with the longitudinal direction of the respective carrying bar, a plurality of ribs each inserted into one of said grooves of said carrying bars in such a manner so as to support said bars in a substantially parallel position one to the other near the ends of said ribs and being substantially perpendicular to said ribs, each of said ribs having two substantially circular holes, one each on either end, which, upon the insertion of said ribs into said grooves, is at least partially located inside the walls of each tubular carrying bar, the projection of the holes in the ribs in a plane perpendicular to the longitudinal direction of the respective carrying bar being elliptical in shape, each hole having a size and location which permits a rod to be inserted within the walls of each carrying bar through the holes in said ribs, turned about their longitudinal axis so as to abut those parts of the grating which define those portions of the holes which are located inside the tubular walls of the carrying bars and locked against the ribs by deformation of the walls, the square rods having a cross section with a diagonal exceeding in length the longest side of the cross section, the diagonal being smaller than the diameter of the holes such that the rods can readily be inserted from the end of the carrying bars into the holes inside the walls of the tubular carrying bars, and the diagonal further being longer than the small axis of said ellipse.

8. A grating according to claim 7, in which the ribs near said holes are provided with a recess defining a tip of the respective rib, said recesses and tips having a form so adjusted to the carrying bars that upon insertion of a rib into one of said grooves in said carrying bar one of said holes at least partially is located inside of the tube wall of the carrying bar, the recess near the hole partially enclosing the tube wall of the carrying bar at the same time as the tip partially is enclosed by said tube wall.

9. A grating according to claim 8, comprising two locking plates for locking said square rods about their longitudinal axis in relation to the respective carrying bar, which locking plates are provided with recesses adjusted to the section and turning of the respective square rod and have outer dimensions adjusted to the respective carrying bar, so that the locking plates at least partially can be inserted from the end each into a carrying bar, such that the respective square rod passes through the recess only when the square rod has the proper orientation relative to the surrounding carrying bar.

* * * * *